US005476257A

United States Patent [19]

Bobby

[11] Patent Number: 5,476,257

[45] Date of Patent: Dec. 19, 1995

[54] TENNIS RACKET STROKE TRAINING DEVICE

[76] Inventor: Andrew Bobby, 17 Century Ct., Montville, N.J. 07045

[21] Appl. No.: 282,559

[22] Filed: Sep. 12, 1994

[51] Int. Cl.[6] ..... A63B 69/38

[52] U.S. Cl. ..... 273/29 A

[58] Field of Search ..... 273/29 A, 26 R, 273/29 R, 189 R, 191 R, 190 B, 191 B

[56] References Cited

U.S. PATENT DOCUMENTS

| | | | |
|---|---|---|---|
| 2,498,006 | 2/1950 | Ridill | 273/189 R |
| 3,595,583 | 7/1971 | Oppenheimer | 273/191 R |
| 3,858,881 | 1/1975 | Hurwitz | 273/29 A |
| 3,937,465 | 2/1976 | Roland | 273/29 A |
| 4,030,723 | 6/1977 | Vincent | 273/29 A |
| 4,150,821 | 4/1979 | Racz | 273/29 A |
| 4,691,924 | 9/1987 | Strong | 273/189 R |

FOREIGN PATENT DOCUMENTS

| | | | |
|---|---|---|---|
| 2281038 | 2/1976 | France | 273/29 A |
| 2449360 | 4/1976 | Germany | 273/29 A |
| 4016588 | 11/1991 | Germany | 273/29 A |

OTHER PUBLICATIONS

The "Sporting Goods Dealer", Sep. 1976.

*Primary Examiner*—Theatrice Brown
*Attorney, Agent, or Firm*—Alfred C. Hill

[57] ABSTRACT

A tennis training device comprising a first arrangement surrounding a selected one of a upper arm above an elbow of a tennis player and a lower arm below the elbow of the tennis player; and a second arrangement connected between the first arrangement and a tip of a tennis racket head held in the hand of the tennis player to produce a classic tennis stroke from an early lower preparation to a high and complete follow-through while correctly positioning the associated shoulder, the arm, the elbow, the associated wrist and the hand of the tennis player relative to each other during the classic stroke.

20 Claims, 1 Drawing Sheet

FIG. 3
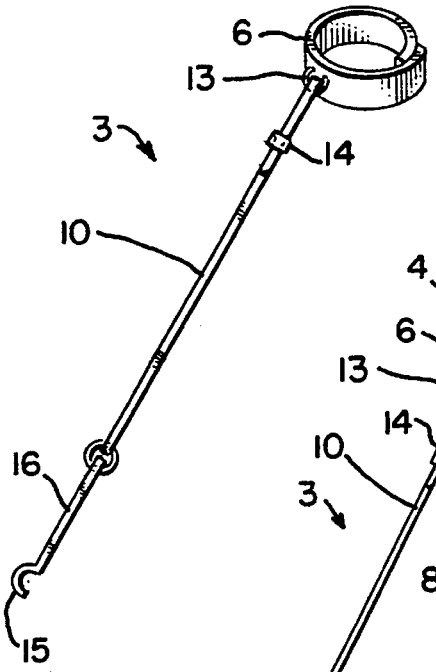
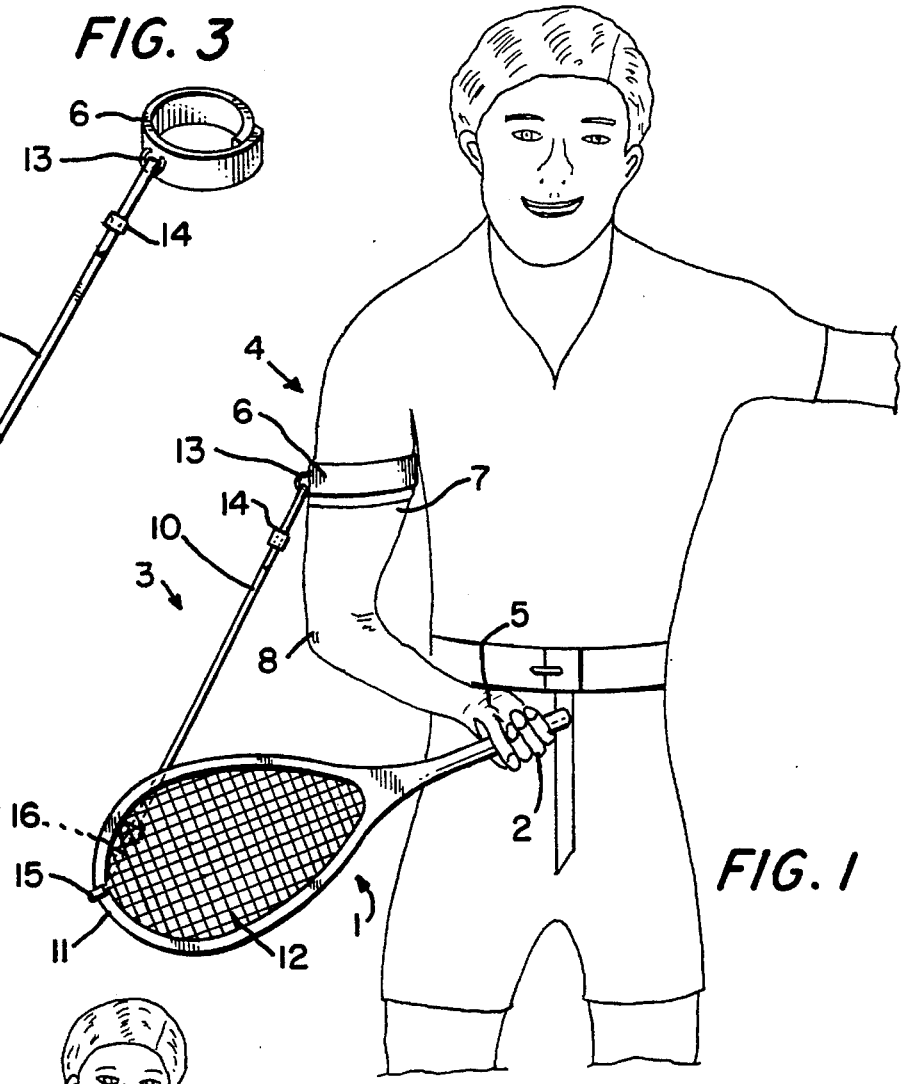
FIG. 1
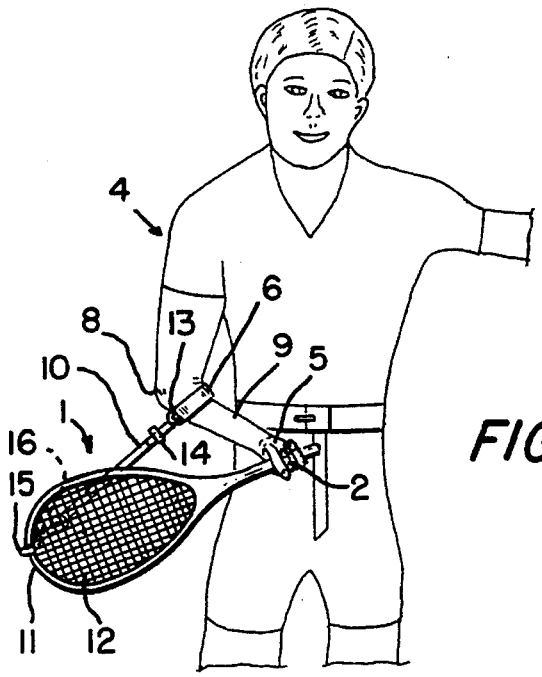
FIG. 2

TENNIS RACKET STROKE TRAINING DEVICE

BACKGROUND OF THE INVENTION

The present invention relates to athletic training equipment and more particularly to an improved tennis training device.

Various devices have been proposed for helping a beginning player to position the racket in the proper manner. Three such devices are disclosed in U.S. Pat. Nos. 3,693,973; 3,858,881 and 4,150,821. The training device of U.S. Pat. No. 3,693,973 is a totally inflexible, splint-like device that most novices would find very difficult to use. The training device of U.S. Pat. No. 3,858,881 is less restrictive than the training device of the previous patent but its effectiveness is doubted. The training device of U.S. Pat. No. 4,150,821 is primarily for preventing tennis elbow and the stated objective of properly holding the tennis racket is secondary.

The training device of U.S. Pat. No. 3,858,881 comprises an elastic cord that is looped around the racket handle and extends from that point to a ring on a known type of adjustable compression band that is worn on the player's forearm. The connection with the racket handle is not sufficiently positive to offer any real support in maintaining the proper positioning of the racket and the forearm band can slip or shift position. If the band is pulled so tight that it cannot shift, and will probably cut off circulation in the player's arm.

In U.S. Pat. No. 4,150,821, the training device operates to reduce the likelihood of developing tennis elbow. This training device is comprised of a totally flexible strap that extends from a fitting on the head of the players racket to a member engaging the players wrist. The fitting is attached to the racket head at approximately its widest transverse point. The connecting strap is an aid in establishing the desired angular relationship between the player's wrist and the longitudinal axis of the racket. At the same time, the connecting strap minimizes the possibility of stretching or overextending the extensor muscles of the players forearm which stretching frequently leads to the injury known as tennis elbow.

SUMMARY OF THE INVENTION

An object of the present invention is to provide an improved tennis training device.

Another object of the present invention is to provide a tennis training device that properly limits movement, controls the racket head and guides the tennis stroke so that the stroke path, or classic tennis stroke is properly executed.

Still another object of the present invention is to provide a tennis training device that permits repetitious classic tennis stroking for the development of muscle memory so that the tennis player can include effective stroke production almost subconsciously, freeing his or her mind to create and react to patterns and strategies in competitive play under the pressure of the moment.

A further object of the present invention is to provide a tennis training device that helps to guide the tennis stroke so that the path of the stroke is simulated to produce a classic stroke from early racket preparation to a high and complete follow through while correctly positioning the shoulder, the arm, the elbow, the wrist and the hand of the player relative to each other during the classic stroke.

A feature of the present invention is the provision of a tennis training device for a tennis player comprising first means surrounding a selected one of an upper arm above an elbow of the player and a lower arm below the player elbow; and second means connected between the first means and a tip of a tennis racket held in the hand of the player to produce a classic tennis stroke from an early lower racket preparation to a high and complete follow-through while correctly positioning the associated shoulder, the arm, the elbow, the associated wrist and the hand of the player relative to each other during the classic stroke.

BRIEF DESCRIPTION OF THE DRAWING

Above-mentioned and other features and objects of the present invention will become more apparent by reference to the following description taken in conjunction with the accompanying drawing, in which:

FIG. 1 is a front view of a tennis player holding a tennis racket incorporating a first embodiment of the tennis training device in accordance with the principles of the present invention;

FIG. 2 is a front view of a tennis player holding a tennis racket incorporating a second embodiment of the tennis training device in accordance with the principles of the present invention; and FIG. 3 is a perspective view of the tennis training device incorporated in FIGS. 1 and 2 in accordance with the principles of the present invention.

DESCRIPTION OF THE PREFERRED EMBODIMENTS

Referring to FIGS. 1 and 2, there is illustrated therein a tennis player gripping a tennis racket 1 in his hand 2. The tennis training device 3 of the present invention coupled to the tennis racket 1 and the tennis player's arm 4 as illustrated will position the entire arm 4 from shoulder to hand in a proper position for the classic tennis stroke with the wrist 5 laid back.

When incorporating the tennis training device of the present invention the device 3 helps to guide the tennis stroke so that the path of the stroke simulates a classic tennis stroke from an early lower racket preparation to a high and complete follow-through while correctly positioning the relationship between the shoulder, the arm, the elbow, wrist and hand for sequential stroking to properly develop muscle memory so that the stroke production becomes almost subconscious thereby freeing the tennis player's mind to create and react to patterns and strategies in competitive play under the pressure of the moment.

Referring to FIGS. 1, 2, and 3, the tennis training device of the present invention incorporates a first means in the form of a VELCRO band 6, of predetermined width, such as 3 inches wide. Band 6 surrounds a selected one of an upper arm 7 above an elbow 8 of the player (as shown in FIG. 1) and a lower arm 9 below elbow 8 (as shown in FIG. 2). A second means in the form of an adjustable strap 10 is connected between band 6 and a tip 11 of a tennis racket head 12 held in the hand of a player.

Strap 10 is connected to band 6 by a catch arrangement 13 and is adjustable in length a predetermined amount by adjustable buckle 14. Preferably strap 10 is adjustable from 16 inches to 32 inches and is 1 inch wide.

A slip clamp 15 attaches strap 10 to the tip 11 of racket head 12, the strap 10 having a portion thereof that is elasticized, such as portion 16. Elasticized portion 16 is connected to the end of strap 10 remote from the band 6 and preferably is expandable from 3 inches to 6 inches in length and is 1 inch wide.

The purpose of the elasticized portion 16 is to provide a "give" so that portion 16 will expand as a result of the easy flowing forward force exerted from a "laid-back" wrist as the wrist 5 moves up and forward into the hit of the tennis ball and then straightens out from the lower arm 9 at 180° going into a full follow-through up and out with the hand 2 ending approximately between the left ear and left shoulder for a right-handed tennis player.

The adjusting buckle 14 enables adjustment of the tennis training device of the present invention to fit an individual's measurements and will control and guide the shoulder, upper and lower arm, elbow, wrist and hand to simulate the sequential proper relationship of body parts in execution of a classic tennis stroke. Buckle 14 also permits adjustment of the length of the strap 10 to accommodate both ground strokes and volley strokes.

When the training device of the present invention is positioned so that band 6 is above the elbow 8 as shown in FIG. 1 the tennis player can practice volley strokes.

When the tennis training device of the present invention has the band 6 disposed in the lower arm 9 just below the elbow 8 as shown in FIG. 1 the tennis player can practice ground strokes.

The adjustment of the strap 10 from ground strokes to volleys is a shortening of the strap 10 of approximately 6 inches.

While I have described above the principles of my invention in connection with specific apparatus, it is to be clearly understood that this description is made only by way of example and not as a limitation to the scope of my invention as set forth in the objects thereof an in the accompanying claims.

I claim:

1. A training device for a tennis player comprising:

first means surrounding a selected one of an upper arm above an elbow of said player and a lower arm immediately below said elbow; and second means connected extending between and connected to said first means and the tip of said longitudinal tennis racket head, said second means having a portion thereof extending across and substantially parallel to a ball striking surface portion of said racket head when held in a hand of said player to enable practicing a classic tennis stroke from an early lower racket preparation to a high and complete follow-through while correctly positioning the associated shoulder, said arm, said elbow, the associated laid-back wrist and said hand of said player relative to each other during said classic stroke.

2. A device according to claim 1, wherein said first means includes a band of predetermined width.

3. A device according to claim 2, wherein said band is a VELCRO band.

4. A device according to claim 3, wherein said second means includes a clamp removably secured to said tip of said racket, an adjustable strap having one end connected to said band, and an elastic strap connected between the other end of said adjustable strap and said clamp.

5. A device according to claim 1, wherein said second means includes a clamp removably secured to said tip of said racket, an adjustable strap having one end connected to said first means, and an elastic strap connected between the other end of said adjustable strap and said clamp.

6. A device according to claim 1, wherein said first means surrounds said upper arm to enable training for volley strokes.

7. A device according to claim 6, wherein said first means includes a band of predetermined width.

8. A device according to claim 7, wherein said band is a VELCRO band.

9. A device according to claim 8, wherein said second means includes a clamp removably secured to said tip of said racket, an adjustable strap having one end connected to said band, and an elastic strap connected between the other end of said adjustable strap and said clamp.

10. A device according to claim 6, wherein said second means includes a clamp removably secured to said tip of said racket, an adjustable strap having one end connected to said first means, and an elastic strap connected between the other end of said adjustable strap and said clamp.

11. A device according to claim 1, wherein said first means surrounds said lower arm to enable training for ground strokes.

12. A device according to claim 11, wherein said first means includes a band of predetermined width.

13. A device according to claim 12, wherein said band is a VELCRO band.

14. A device according to claim 13, wherein said second means includes a clamp removably secured to said tip of said racket, an adjustable strap having one end connected to said band, and an elastic strap connected between the other end of said adjustable strap and said clamp.

15. A device according to claim 11, wherein said second means includes a clamp removably secured to said tip of said racket, an adjustable strap having one end connected to said first means, and an elastic strap connected between the other end of said adjustable strap and said clamp.

16. A device according to claim 1, wherein said second means includes a clamp removably secured to said tip of said racket, and an adjustable strap connected between said first means and said clamp, said adjustable strap having at least a portion thereof that is elasticized.

17. A device according to claim 16, wherein said first means surrounds said upper arm to enable training for volley strokes.

18. A device according to claim 17, wherein said first means includes a VELCRO bend having a predetermined width.

19. A device according to claim 16, wherein said first means surrounds said lower arm to enable training for ground strokes.

20. A device according to claim 19, wherein said first means includes a VELCRO band having a predetermined width.

* * * * *